US005330367A

United States Patent [19]

Janczak

[11] Patent Number: 5,330,367

[45] Date of Patent: Jul. 19, 1994

[54] CUTTING AND CLAMPING TERMINAL ELEMENT

[75] Inventor: Andrzej Janczak, Berlin, Fed. Rep. of Germany

[73] Assignee: Krone Aktiengesellschaft, Berlin, Fed. Rep. of Germany

[21] Appl. No.: 25,967

[22] Filed: Mar. 3, 1993

[30] Foreign Application Priority Data

Mar. 4, 1992 [DE] Fed. Rep. of Germany ..... 4207369

[51] Int. Cl.[5] ..... H01R 4/24

[52] U.S. Cl. ..... 439/402; 439/395

[58] Field of Search ..... 439/395–407, 439/417–419

[56] References Cited

U.S. PATENT DOCUMENTS

| | | | |
|---|---|---|---|
| 3,829,827 | 8/1974 | Geiser et al. | 439/402 |
| 4,840,578 | 6/1989 | Sato | 439/402 |
| 4,948,382 | 8/1990 | Marpoe, Jr. et al. | 439/406 |

FOREIGN PATENT DOCUMENTS

| | | | |
|---|---|---|---|
| 0206242 | 12/1986 | European Pat. Off. | 439/725 |

*Primary Examiner*—David L. Pirliot
*Attorney, Agent, or Firm*—McGlew & Tuttle

[57] ABSTRACT

The invention relates to a cutting and clamping terminal element for contacting electrical conductors, in particular for cable cores of the telecommunication technology, comprising a U-shaped section piece of a U-shaped cross-section and having a cutting and clamping contact. In order to provide a cutting and clamping terminal element (1) by means of which a plurality of parallel electrical conductors (6) can be terminated and accurately positioned and guided, the U-shaped section piece (2) is adapted with one or several central webs (3), which are cut free from the bottom portion (7) and are upwardly bent off. Thereby one or more contact positions 9 are obtained for the electrical conductors (6).

20 Claims, 8 Drawing Sheets

CUTTING AND CLAMPING TERMINAL ELEMENT

FIELD OF THE INVENTION

The invention relates to a cutting and clamping terminal element for contacting electrical conductors and more particularly the invention relates to connecting elements for cable cores of the telecommunication technology including a U-shaped section piece of a U-shaped cross-section having a cutting and clamping contact.

BACKGROUND OF THE INVENTION

A cutting and clasping terminal element of the kind referred to is described in the prior DE patent 40 33 366. This cutting and clamping terminal element is adapted as a U-shaped section piece. The contact legs are cut free, for forming the cutting and clamping contact, from the two side walls of the section piece, and are inwardly bent off between the side walls. The two contact legs form a clamping slot, into which a cable core can be pressed in. With multiple-core cables, only one core per terminal element can be contacted, not however several cores in parallel to each other. This affects, in particular, the application of the terminal element for the SMD technology. One core each can only be connected with the printed-circuit board.

SUMMARY OF THE INVENTION

It is therefore the object of the present invention to improve a cutting and clamping terminal element of the kind referred to such that a plurality of parallel electrical conductors can be terminated in a terminal element, and can accurately be positioned and guided.

According to the invention, a cutting and clamping terminal element is provided for contacting electrical conductors such as cable cores of telecommunication technology, wherein the cutting clamping terminal elements comprises a U-shaped piece with cutting and clamping contacts formed of a central web cut free from a bottom portion of the U-shaped section piece, the central web being upwardly bent off parallel to side walls of the U-shaped section piece.

According to further aspects of the invention, the central web may either by bent upwardly from a center of the bottom portion toward one of the front sides, or may be bent from a front side toward the center. Plural central webs may be provided and several central webs may also be provided which are parallel to each other as well as parallel to the side walls. Further, opposed contact strips may be cut free from the side walls and inwardly bent off to cooperate with the cutting clamping contact formed by the at least one central web.

The construction of the U-shaped section piece having at least one central web permits, besides a safe guiding of the electrical conductor through the respective side wall and the bottom portion and the at least one central web serving as a contact position, the parallel termination of several electrical conductors in a terminal element. The cutting and clamping terminal element is, due to its construction, well suited for application on printed-circuit boards in conjunction with the SMD technology (surface-mount devices). Another advantage is that the cutting and clamping terminal element will not require a case in order to position the electrical conductors; it is self-supporting and does not need any reinforcement structure members.

A further object of the invention is to provide a cutting and clamping terminal element such that plural parallel electrical conductors can be terminated, which cutting and clamping terminal element is simple in design, rugged in construction and economical to manufacture.

The various features of novelty which characterize the invention are pointed out with particularity in the claims annexed to and forming a part of this disclosure. for a better understanding of the invention, its operating, advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
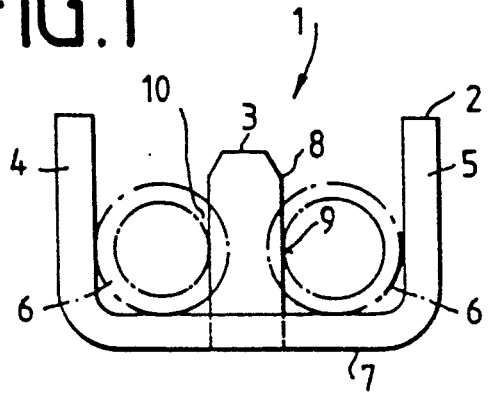
FIG. 1 is a front end view of the cutting and clamping terminal element according to a first embodiment of the invention.
Figure 3:
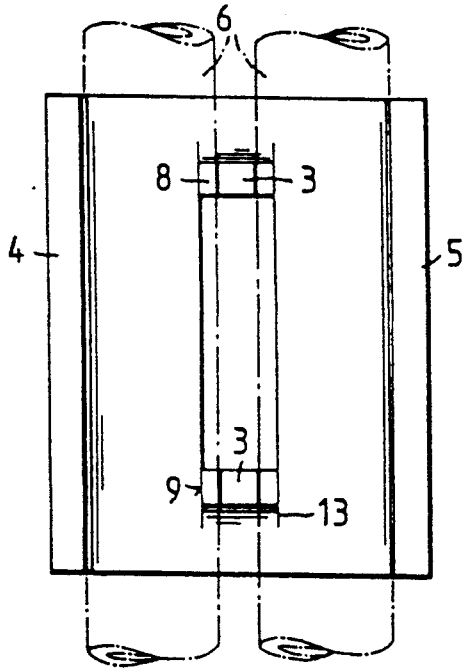
FIG. 3 is a top view of the cutting and clamping terminal element according to FIG. 1.
Figure 2:
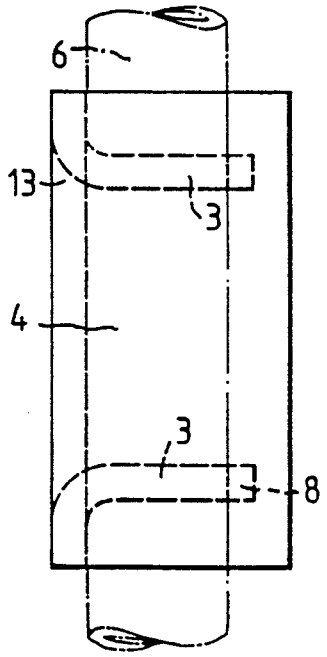
FIG. 2 is a side view of the cutting and clamping terminal element according to FIG. 1.

FIGS. 1 to 3 show the first embodiment of the cutting and clamping terminal element 1. It is adapted as a U-shaped section piece 2 made of an electrically conductive metal material. The section piece 2 comprises two side walls 4, 5, which are rectangularly bent off from the bottom portion 7. In the central axis of the bottom portion 7, two central webs 3 are cut out and are rectangularly bent towards top, from the center to the front sides of the section piece 2. By the cutout of the central webs 3, and by bending them upwardly, the curvature radii 13 are generated. The central webs 3 form the termination positions for the electrical conductors 6, between the central axis of the conductor and the contact positions, an angle of 90° being formed. The inclined notch portions 8 formed at an angle of approximately 45° at the upper edge of the central web 3 cause cuts in the possibly existing insulation of the electrical conductor 6. The distance between a side wall 4, 5 and the central web 3 forms a cutting and stamping contact means which is slightly smaller than the diameter of the electrical conductor 6 to be terminated, so that a solid clamping connection and a good contact are guaranteed. The length of the section piece 2 is freely selectable. In the embodiment according to FIGS. 1 to 3, the cutting and clamping terminal element 1 is adapted for two electrical conductors, which are terminated over two contact positions 9 each formed by the central webs 3.

For terminating an electrical conductor 6, e.g. in the form of cable cores of the telecommunication and data technology, at the cutting and clamping terminal element 1, the electrical conductor 6 is inserted from above parallely between a side wall 4, 5 and the central webs 3 into the section piece 2. The electrical conductor 6 is held in place by the inner faces of the side walls 4, 5 and the contact faces of the central webs 3. The electrical conductor 6 is pressed into the contact slot of the cutting and clamping contact 10, by means of a non-shown tool, the sharp edges of the front faces of the central webs 3 forming the notching edges 8 and penetrating into the conductive core of the electrical conductor, thereby an electrical connection between the electrical conductor 6 and the contact positions 9 of the cutting and clamping terminal element 1 being established.

Figure 4:
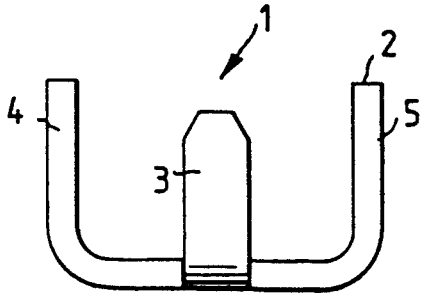
FIG. 4 is a front view of the cutting and clamping terminal element according to a second embodiment of the invention.
Figure 5:
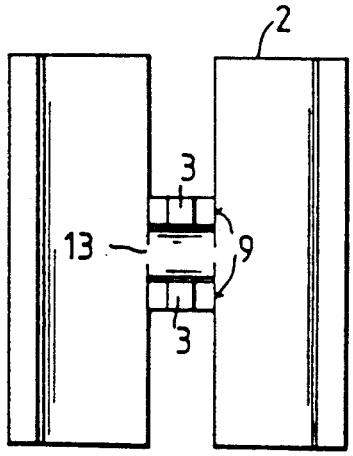
FIG. 5 is a top view of the cutting and clamping terminal element according to FIG. 4, having two central webs.
Figure 6:
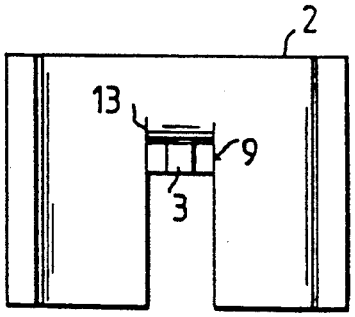
FIG. 6 is a top view of the cutting and clamping terminal element according to FIG. 4, having one central web.

The second embodiment of the cutting and clamping terminal element 1 is represented in FIGS. 4 to 6. It differs from the first embodiment according to FIGS. 1 to 3 only by that the central webs 3 are upwardly bent off from the two front sides of the section piece towards the center (FIG. 5) or by that the one central web 3 is upwardly bent off from one front side towards the center (FIG. 6), respectively. Thereby, the curvature radii 13 are generated. In the embodiment according to FIG. 6, only one contact position 9 is formed per electrical conductor 6.

The third and fourth embodiments according to FIGS. 7, 8 and 9 to 11 differ from the first and second embodiments according to FIGS. 1 to 3 or 4 to 6, respectively, only by the number of formed central webs 3. The design selected here (FIG. 11) with three central webs 3 permits the termination of each of the four electrical conductors 6 at either one or two contact positions 9. This embodiment shows that, depending on the selected width of the bottom portion 7, it is possible to obtain any desired number of termination positions by lining the basic unit of the cutting and clamping terminal element 1 up, according to FIGS. 1 to 3 or 4 to 6, respectively.

In the fifth embodiment according to FIGS. 12 to 15, four contact positions 9 (FIGS. 14, 15) or three contact positions 9 (FIG. 13), respectively, are provided for each electrical conductor 6. In addition to the two contact positions 9 on each of the central webs 3, contact positions 11 are formed of the side walls 4, 5 of the section piece 2. Contact strips 12 are cut free from the side walls 4, 5, and are bent off into the interior of the section piece 2 such that the conductor positions 11 clamping the electrical conductor 6 are formed. The angle between the longitudinal axis of the cutting and clamping terminal element 1 and the inwardly bent-off contact strips 12 is freely selectable. The angle between the central axis of the respective electrical conductors and the sideways contact strips 12 preferably is 45° to 90°.

The embodiment according to FIGS. 16 to 22 permit the termination of each of two electrical conductors 6 either over four contact positions 9, 11 (FIGS. 17, 18), three contact positions 9, 11 (FIG. 22) or two contact positions 9, 11 (FIGS 19, 20, 21), respectively. The design of the central webs 3 corresponds to that in FIGS. 5, 6. The design of the contact strips 12 corresponds to that in FIGS. 12 to 15.

Figure 7:
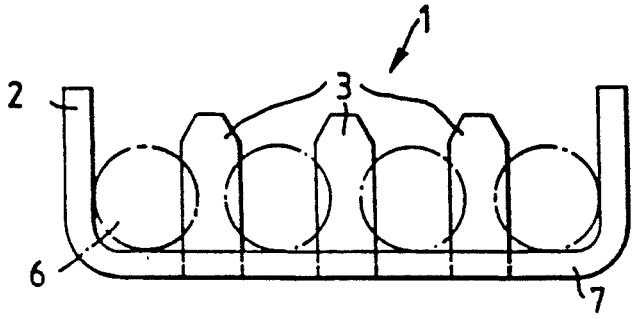
FIG. 7 is a front view of the cutting and clamping terminal element according to a third embodiment of the invention, having three rows of central webs.
Figure 8:
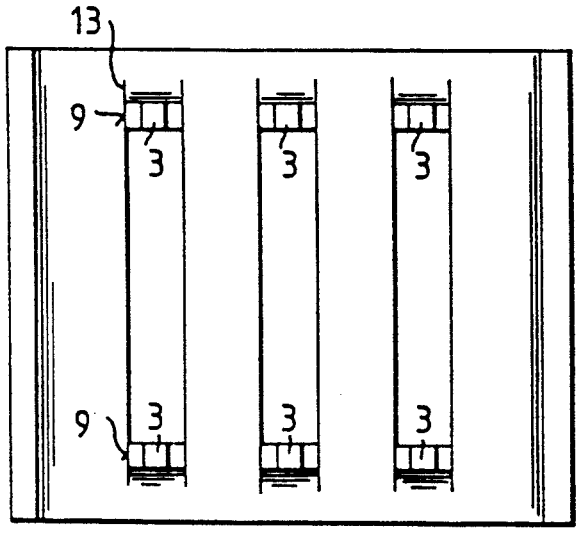
FIG. 8 is a top view of the cutting and clamping terminal element according to FIG. 7.
Figure 9:
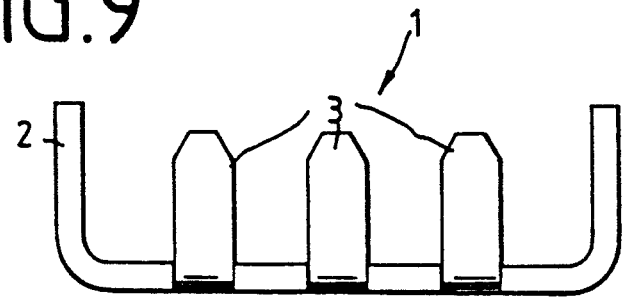
FIG. 9 is a front view of the cutting and clamping terminal element according to a fourth embodiment of the invention, having four rows of central webs.
Figure 10:
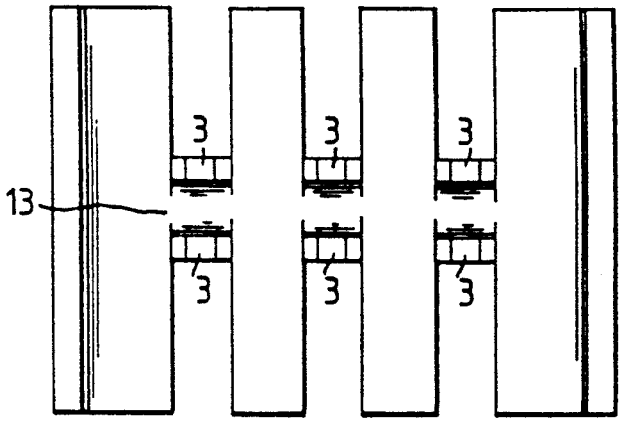
FIG. 10 is a top view of the cutting and clamping terminal element according to FIG. 9, having two central webs per row.
Figure 11:
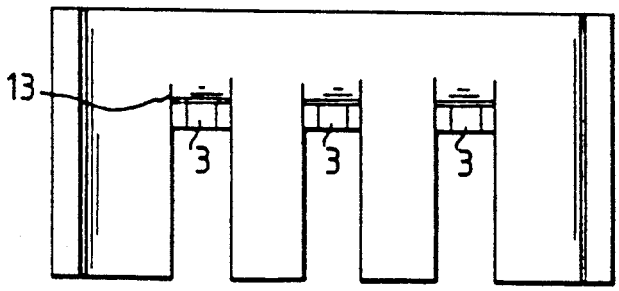
FIG. 11 is a top view of the cutting and clamping terminal element according to FIG. 9, having one central web per row.
Figure 12:
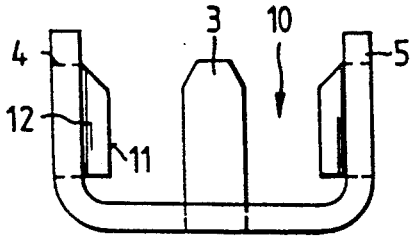
FIG. 12 is a front view of the cutting and clamping terminal element according to a fifth embodiment of the invention, having one central web and contact positions at the side walls.
Figure 13:
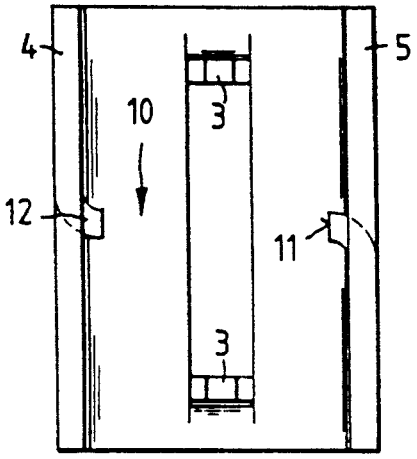
FIGS. 13 to 15 are top views of the cutting and clamping terminal element according to FIG. 12 in various embodiments.
Figure 14:
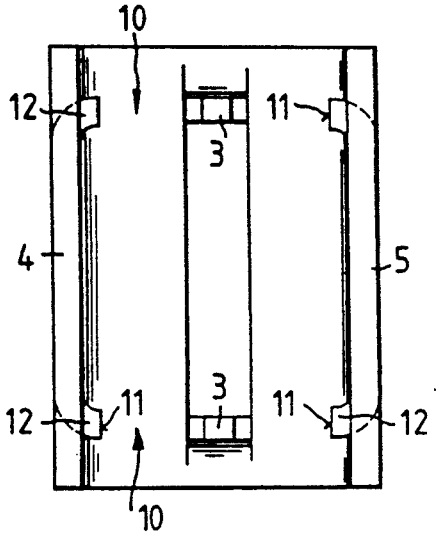
Figure 15:
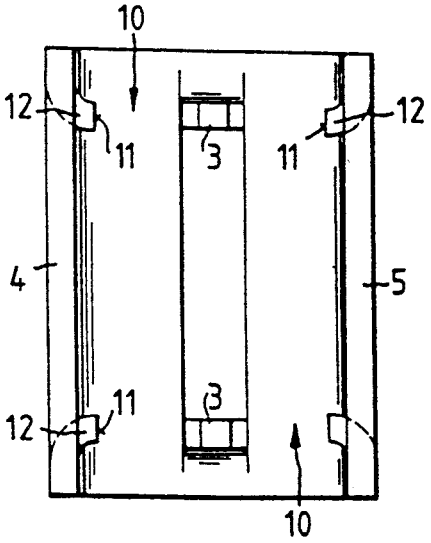
Figure 16:
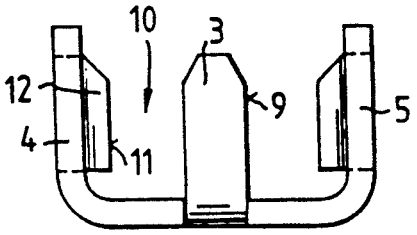
FIG. 16 is a front view of the cutting and clamping terminal element according to a sixth embodiment of the invention, having one central web and contact positions at the side walls.
Figure 17:
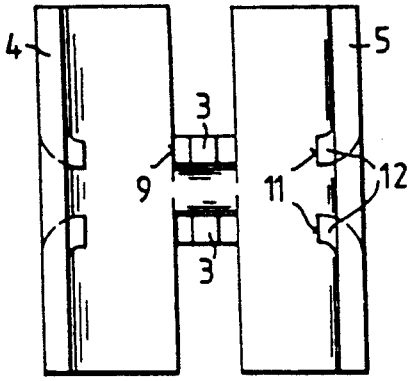
FIGS. 17 to 22 are top views of the cutting and clamping terminal element according to FIG. 16 in various embodiments.
Figure 18:
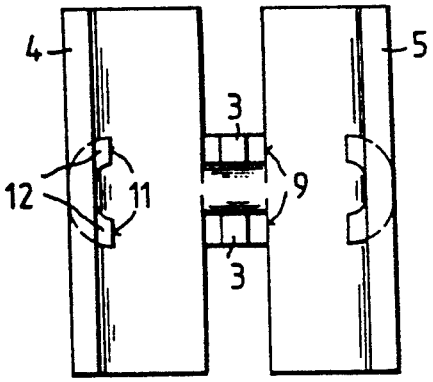
Figure 19:
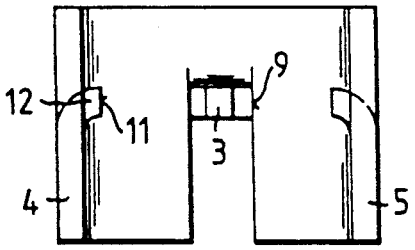
Figure 20:
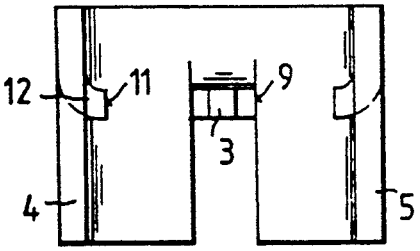
Figure 21:
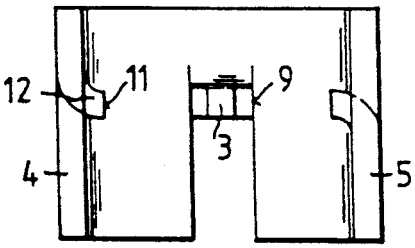
Figure 22:
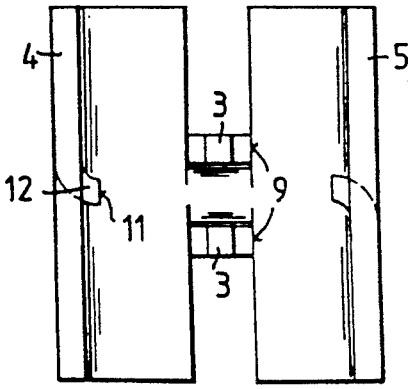
Figure 23:
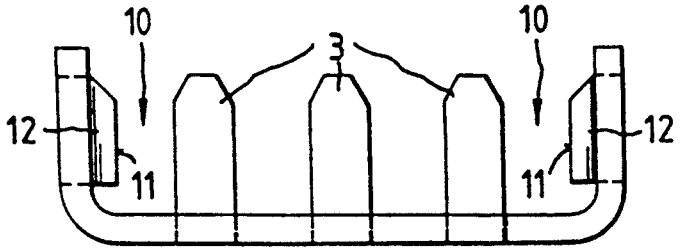
FIG. 23 is a front view of the cutting and clamping terminal element according to an embodiment of the invention, having three rows of central webs and contact positions at the side walls.
Figure 24:
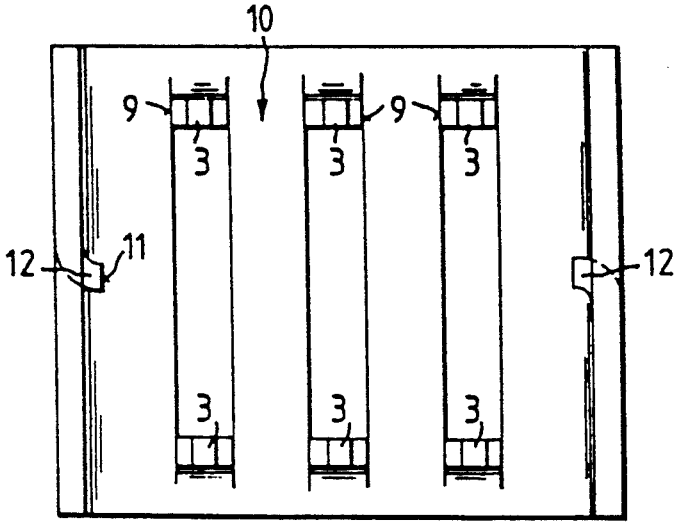
FIGS. 24 and 25 are top views of the cutting and clamping terminal element according to FIG. 23 in various embodiments.
Figure 25:
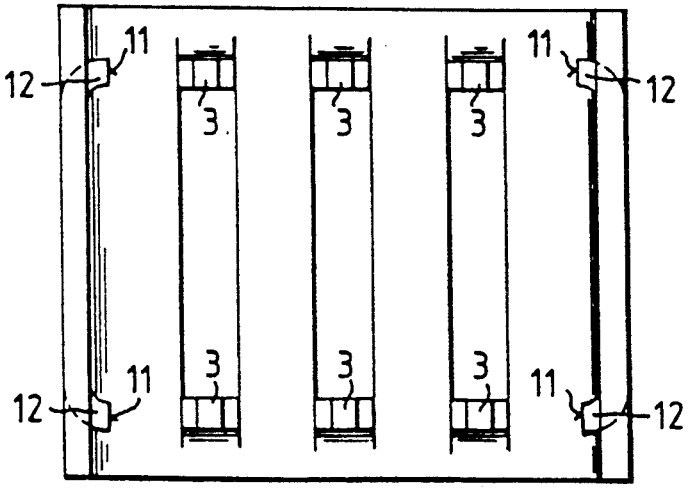
Figure 26:
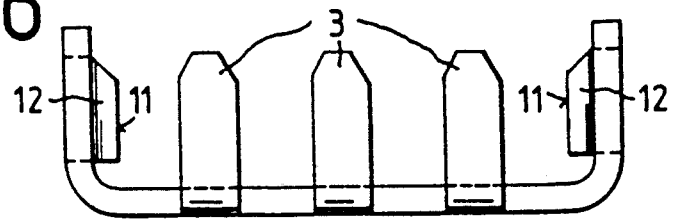
FIG. 26 is a front view of the cutting and clamping terminal element according to a seventh embodiment of the invention, having three rows of central webs and contact position at the side walls.
Figure 27:
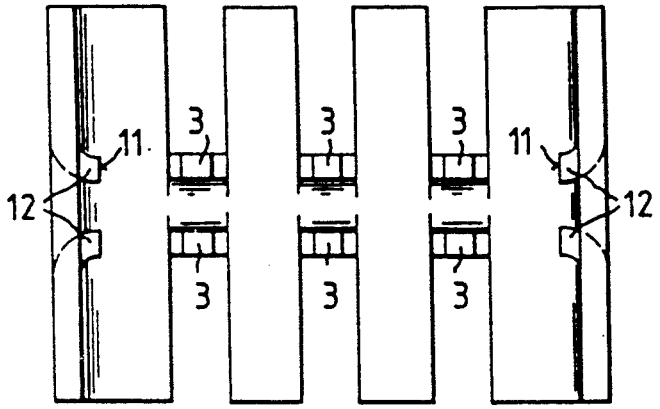
FIGS. 27 to 29 are top views of the cutting and clamping terminal element according to FIG. 26 in various embodiments.
Figure 28:
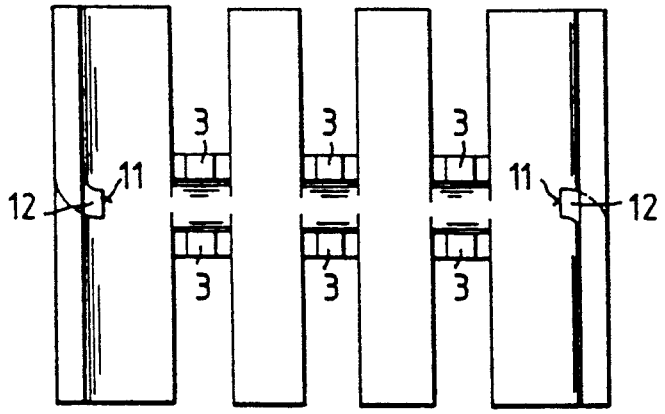
Figure 29:
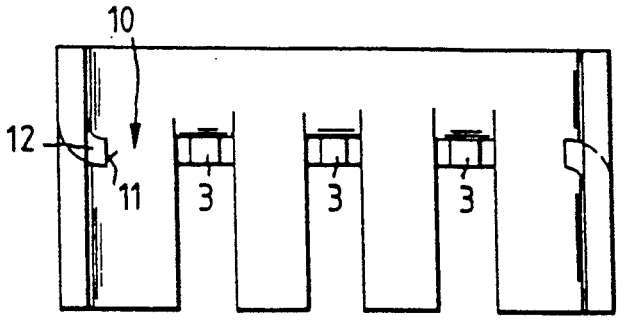

The embodiment in FIGS. 23 to 25 and in FIGS. 26 to 29 show constructions of the cutting and clamping terminal element 1 for four electrical conductors 6 with central webs 3 according to FIGS. 7 and 9, and with contact strips 12 according to FIGS. 13 to 15.

The individual embodiment of the central web 3 and of the contact strips 12 can be combined in any desired manner, and can be extended for any desired number of electrical conductors 6 by lining the basic units according to FIGS. 1, 4, 12, 16 up.

These embodiments can be employed, by suitable selection of the height of the U-section, i.e. of the side walls 4, 5 of the section piece 2, also for double contacting at one contact position, if the electrical conductors 6 have nearly identical diameters.

The described cutting and clamping terminal element 1 is suitable for applications as a core connecting device for stripped and for insulated wires 6 in full-wire of stranded-wire forms, or for connecting the same number of conductors 6 with a printed-circuit board, e.g. as an SMD contact. The metal diameter of full wires may be 0.3 mm to approximately 1 mm, depending on size. The terminal element 1 can also be employed in connector banks without disconnect function. The cutting and clamping terminal element 1 is self-supporting. No additional structure parts, such as cases, supports or the like, are required for reinforcement. The electrical conductors 6 may be cut to correct length, prior to wiring, or may be separated, when pressing-in, at a metal edge, by the press-in force. This edge may be bent off from the contact. Further, a special wiring tool may be used for this purpose.

While specific embodiments of the invention have been shown and described in detail to illustrate the application of the principles of the invention, it will be understood that the invention may be embodied otherwise without departing from such principles.

What is claimed is:

1. A cutting and clamping terminal element for contacting electrical conductors, particularly for cable cores of telecommunication technology, comprising:

a U-shaped section piece including a bottom portion, and first and second opposite side walls; and a central web cut free from said bottom portion of the U-shaped section piece and upwardly bent off, said central web being spaced from said first side wall, said central web, said first side wall and a distance between said central web and said first side wall forming a cutting and clamping contact means for receiving a cable core.

2. A cutting and clamping terminal element according to claim 1, wherein said cutting and clamping contact further includes at least two opposed contact strips cut free from said side walls of said section piece and inwardly bent-off between said side walls.

3. A terminal element in accordance with claim 1, wherein:

said cutting and clamping contact means forms an electrical connection between said U-shaped section and the cable core, said cutting and clamping contact means positions the cable core completely between said central web and said first side wall.

4. A terminal element in accordance with claim 1, further comprising:

an additional central web cut free from said bottom portion of the U-shaped section piece and upwardly bent off, said additional central web being spaced from said first side wall and said central web, said central web and said another central web being positioned in a line substantially parallel with said first side wall, said additional central web and said first side wall forming another cutting and clamping contact means for receiving the cable core.

5. A terminal element in accordance with claim 1, further comprising:

an additional central web cut free from said bottom portion of the U-shaped section piece and upwardly bent off, said additional central web being spaced from said second side wall and said central web, said central web and said another central web being positioned in a line substantially perpendicular with said first side wall, said additional central web and said second side wall forming another cutting and clamping contact means for receiving another cable core, said central web and said another central web forming still another cutting and clamping contact means for receiving still another cable core.

6. A cutting and clamping terminal element according to claim 1, wherein a plurality of central webs are cut free from said bottom portion parallel to said side walls and to each other, and upwardly bent off.

7. A cutting and clamping terminal element according to claim 6, wherein said central webs are upwardly bent off, from a central area of said bottom portion towards one of the front sides of said bottom portion of said section piece.

8. A cutting and clamping terminal element according to claim 6, wherein said central webs are upwardly bent off, from a central area of said bottom portion towards one of a front end and a rear end of said bottom portion of said section piece.

9. A cutting and clamping terminal element according to claim 6, wherein said central webs are upwardly bent off, from one of a first end and a rear end of said bottom portion towards a central area of said bottom portion of said section piece.

10. A cutting and clamping terminal element according to claim 6, wherein said central webs are upwardly bent off, from both a front end and a rear end of said bottom portion towards a central area of said bottom portion of said section piece.

11. A cutting and clamping terminal element according to claim 1, wherein said central web is upwardly bent off from a center of said bottom portion towards one of a front end and a rear end of said bottom portion.

12. A cutting and clamping terminal element according to claim 11, wherein said cutting and clamping contact further includes at least two opposed contact strips cut free from said side walls of said section piece and inwardly bent-off between said side walls.

13. A cutting and clamping terminal element according to claim 1, wherein two central webs are provided bent off from said bottom portion, each of the central webs extending from a central area of said bottom portion toward one of a rear end and a front end of said bottom portion.

14. A cutting and clamping terminal element according to claim 13, wherein said cutting and clamping contact further includes at least two opposed contact strips cut free from said side walls of said section piece and inwardly bent-off between said side walls.

15. A cutting and clamping terminal element according to claim 1, wherein said central web is upwardly bent off from a center of one of a rear end and a front end of said bottom portion toward a central area of said bottom portion located between said rear end and said front end.

16. A cutting and clamping terminal element according to claim 15, wherein said cutting and clamping contact further includes at least two opposed contact strips cut free from said side walls of said section piece and inwardly bent-off between said side walls.

17. A cutting and clamping terminal element according to claim 1, wherein plural central webs are upwardly bent off, from a rear end and front end of said bottom portion a central area of said bottom portion provided of the section piece.

18. A cutting and clamping terminal element according to claim 17, wherein said cutting and clamping contact further includes at least two opposed contact strips cut free from said side walls of said section piece and inwardly bent-off between said side walls.

19. A terminal element in accordance with claim 1, wherein:

said central web and said second side wall forms another cutting and clamping contact means for receiving another cable core.

20. A terminal element in accordance with claim 19, wherein:

said cutting and clamping means and said another cutting and clamping means substantially parallelly terminates the cable core and the another cable core.

* * * * *